US005931309A

United States Patent [19]

Andersson

[11] Patent Number: 5,931,309

[45] Date of Patent: Aug. 3, 1999

[54] MAGNETIC SEPARATOR WITH INCLINED CONVEYANCE

[75] Inventor: Einar Andersson, Älmhult, Sweden

[73] Assignee: Almhults El Mek AB, Almhult, Sweden

[21] Appl. No.: 09/051,289

[22] PCT Filed: Oct. 9, 1996

[86] PCT No.: PCT/SE96/01276

§ 371 Date: May 11, 1998

§ 102(e) Date: May 11, 1998

[87] PCT Pub. No.: WO97/13582

PCT Pub. Date: Apr. 17, 1997

[30] Foreign Application Priority Data

Oct. 10, 1995 [SE] Sweden ..... 9503509

[51] Int. Cl.[6] ..... B03C 1/00

[52] U.S. Cl. ..... 209/223.1; 209/225; 209/231; 209/215

[58] Field of Search ..... 209/223.1, 225, 209/231, 215

[56] References Cited

U.S. PATENT DOCUMENTS 536,226 3/1895 McKinnon ..... 209/225
673,172 4/1901 McKnight ..... 209/225 X
3,276,581 10/1966 Mayer et al. ..... 209/223.1
3,756,401 9/1973 Rosner ..... 209/223.1 X

FOREIGN PATENT DOCUMENTS 2 261 833 6/1993 United Kingdom .

OTHER PUBLICATIONS

Patent Abstracts of Japan, vol. 7, No. 22 (C–148), Nov. 6, 1982, (JP–A–57–180442).

*Primary Examiner*—David H. Bollinger
*Assistant Examiner*—Joe Dillon, Jr.
*Attorney, Agent, or Firm*—Vorys, Sater, Seymour and Pease LLP

[57] ABSTRACT

A device for separating metallic and non-metallic materials via an inclined conveyor belt and vibrating plate feed. Feed material is dropped from the feed plate onto the inclined portion of the conveyor. Magnetic material adheres to the inclined belt by attraction to a magnetic plate spaced such that the belt interposes between the magnetic plate and the materials to be separated. Non-metallic materials fall down the incline into a collection area. The device further includes a second magnetic plate, after the first, oriented to diverge from the belt in the direction of conveyance to provide a uniform, attenuating magnetic flux.

7 Claims, 1 Drawing Sheet

MAGNETIC SEPARATOR WITH INCLINED CONVEYANCE

Figure 1:
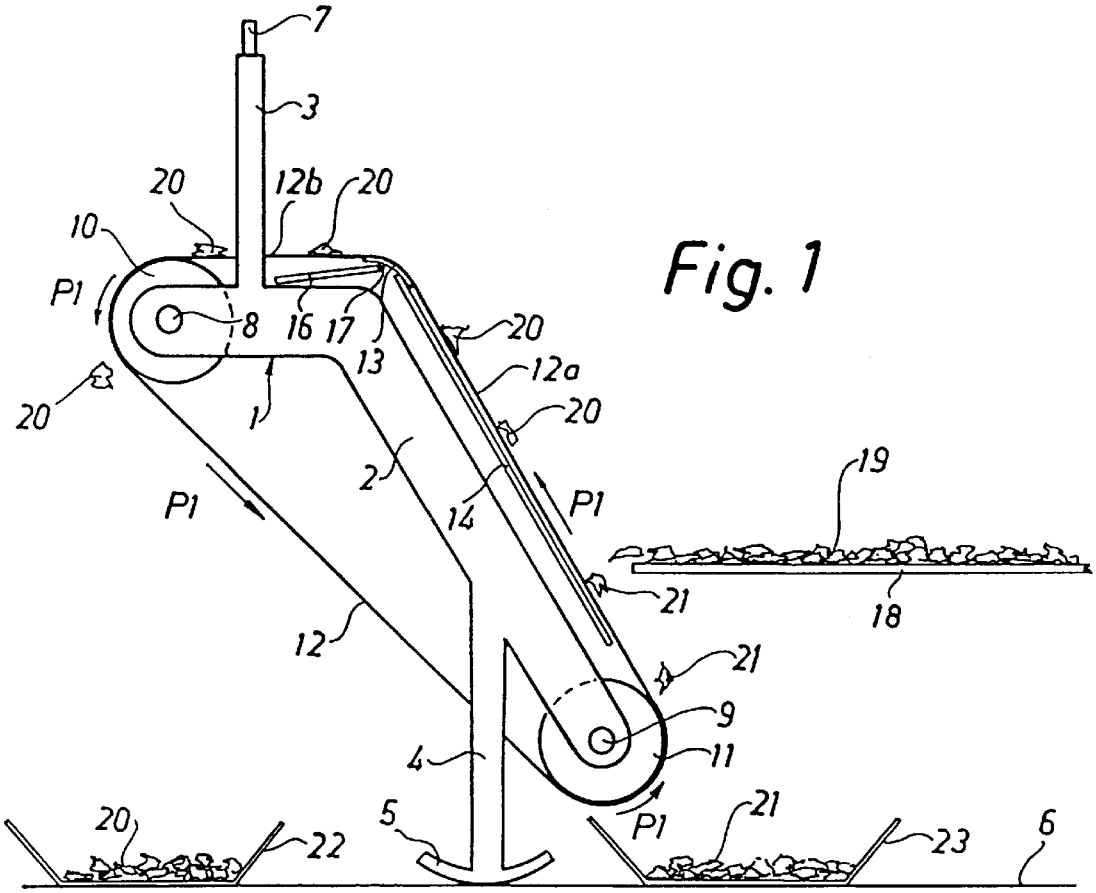

The present invention relates to a device for separating fragments of low-magnetic metallic materials, such as stainless steel of various kinds, from a mixture of such fragments and fragments of non-magnetic materials, such as aluminium, copper, lead, glass, and plastics.

In order to recover recyclable materials, e.g. scrap cars and machinery of various kinds are cut up in so-called fragmentation plants wherein the scrap materials are ground into fragments of various shape and appearance. One then obtains a mixture of fragments of many different materials. Fragments of magnetic materials may be separated in magnetic separating plants whereas fragments of non-magnetic metallic materials may be separated in induction separating plants of the kind described in the Swedish Patent Specifications 8800770-3 and 9103388-6. Fragments of certain low-magnetic metallic materials, such as various kinds of stainless steel, cannot be separated in any one of these two types of plants.

The object of the present invention therefore is to provide a device by means of which fragments of low-magnetic metallic materials may be efficiently separated from a mixture of such fragments and fragments of non-magnetic materials.

This object is achieved by means of a separating device which is characterised by an endless conveyor belt, comprising a first belt run defining a separating plane having an upwards inclination in the direction of movement of the conveyor belt, and a second belt run located at the upper end of the separation plane and defining a discharge section; a first magnetic plate extending in parallel with and closely underneath the first belt run, from the upper end of said first belt run along at least part of the length thereof, and supporting a plurality of permanent magnets arranged in parallel rows of alternate polarity; a transfer unit for transferring the mixture of fragments to the first belt run of the conveyor belt at a predetermined downstream position below which extends the first magnetic plate; and a second magnetic plate disposed below the second conveyor belt run and supporting a plurality of permanent magnets arranged in parallel rows of alternate polarity, said second magnetic plate having such an inclination relatively to the second belt run that the spacing between said second belt run and said second plate increases in the direction of movement of the conveyor belt.

The rows of permanent magnets disposed on the first magnetic plate preferably extend in the transverse direction of the conveyor belt.

The rows of permanent magnets disposed on the second magnetic plate preferably extend in the transverse direction of the conveyor belt. The inclination of the second magnetic plate relatively to the second belt run preferably is adjustable.

The inclination of the separation plane preferably is adjustable, the angle of inclination of the separation plane relatively to the horizontal plane being 40–60°, preferably about 50°.

In accordance with the preferred embodiment the transfer unit consists of a vibrating conveyor.

The invention will be described in the following in more detail with reference to the accompanying drawing, wherein FIG. 1 is a schematic lateral view showing a separating device in accordance with the invention.

Figure 2:
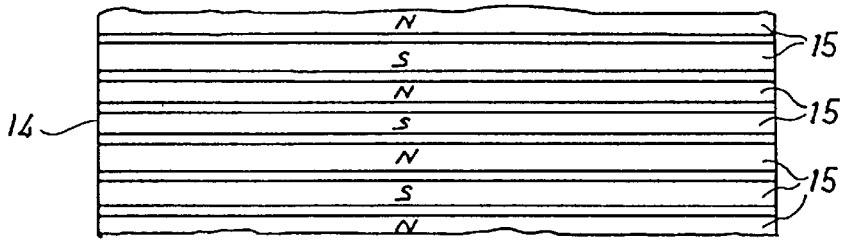

FIG. 2 is an enlarged part view illustrating a cut-away portion of a magnetic plate incorporated in the separating device.

The separating device illustrated in FIG. 1 comprises a frame 1, having two side members 2, only one of which is shown in FIG. 1 and which members are inter-connected at their top by a yoke member 3. Each side member 2 is formed with a leg 4 the lower end of which is provided with an arcuate foot member 5 resting on a horizontal support 6. The yoke member 3 is formed with a suspension eye 7 in which engages a lifting hook (not shown) of a lifting and traversing crane (not shown).

The two side members 2 support a horizontal upper shaft 8 and a horizontal lower shaft 9 extending between the side members. An upper cylinder 10 is mounted on the upper shaft 8 and a lower cylinder 11 on the lower shaft 9. A motor (not shown) is provided to rotate the upper cylinder 10. An endless conveyor belt 12 in the form of a thin rubber cloth having a ribbed external face travels around the two cylinders 10 and 11. During operation of the separating device, the conveyor belt 12 is driven in the direction of arrows P1 by the motor-operated upper cylinder 10. At a point between the two cylinders 10 and 11 an arcuate guide plate 13 divides the part of the conveyor belt 12 that is positioned downstream of the lower cylinder 11 into a first belt run 12*a* extending between the lower cylinder 11 and the guide plate 13, thus defining a separation plane having an upwards inclination in the direction of movement P1 of the conveyor belt 12, and into a second belt run 12*b* extending between the guide plate 13 and the upper cylinder 10, thus forming a discharge section. The guide plate 13 forms a smooth transition between the two conveyor belt runs 12*a* and 12*b*.

The inclination of the separation plane relatively to the horizontal plane is approximately 50° in the embodiment illustrated, whereas the discharge section is essentially horizontal. The angle between the first belt run 12*a* and the second belt run 12*b* thus is approximately 130°. The inclination of the separation plane may be adjusted between approximately 40° and approximately 60° by the lifting and traversing crane connected to the yoke member 3. The angle of inclination is chosen in dependence on the materials to be separated and the desired degree of separation. When the angle of inclination is being set, the device pivots on the arcuate feet members 5.

A first magnetic plate 14 supporting a plurality of permanent magnets is disposed closely underneath the first belt run 12*a* so as to extend in parallel with the latter. The first magnetic plate 14 extends from the guide plate 13 along essentially the entire length of the first belt run 12*a*, covering the entire width of the latter. The permanent magnets consist of blocks having a right-angled parallelepiped shape and are arranged in parallel rows 15 of alternate polarity (N and S). These rows 15 of juxtaposed magnets extend in the transverse direction of the conveyor belt 12, spaced slightly apart in the lengthwise direction of the conveyor belt (see FIG. 2), and are evenly distributed across the entire face of the magnetic plate 14. The magnets are of the kind sometimes referred to as "supermagnets", and in this case are magnets marketed under the tradename "Neodymium". The magnets are maintained in position on the first magnetic plate 14 owing to their strong magnetism.

The second magnetic plate 16 which is designed in exactly the same manner as the first magnetic plate 14, is disposed below the second belt run 12*b* and extends from the guide plate 13 along part of the length of the second belt run 12*b*, covering the entire width thereof. The second magnetic plate 16 is pivotable about a horizontal shaft 17 extending across the conveyor belt 12 and positioned underneath the guide plate 13. The second magnetic plate 16 is set in such a pivoted position that the distance of the said plate to the second belt run 12*a* increases in the direction of movement P1 of the conveyor belt 12. This oblique position serves to create a magnetic field the strength of which decreases along the second belt run 12*b*.

An essentially horizontal vibration conveyor 18 is arranged to convey a mixture 19 of fragments 20 of low-magnetic metallic materials, such as different kinds of stainless steel, and fragments 21 of non-magnetic materials, such as aluminium, copper, lead, glass, and plastics, to the first belt run 12*a* of the conveyor belt 12 at a downstream position A below which extends the first magnetic plate 14 having rows 15 of permanent magnets arranged thereon.

The fragments 20 of low-magnetic metallic materials accompany the moving conveyor belt 12 and thus are being carried obliquely upwards along the separation plane (the first belt run 12*a*), across the guide plate 13 and along the discharge section (the second belt run 12*a*), from whence they fall freely downwards and are collected in a container 22. The fragments 21 of non-magnetic material, on the other hand, do not accompany the moving conveyor belt 12 but slide downwards along the lower section of the first belt run 12*a* to be collected in a container 23.

The separation device in accordance with the invention has proved to be very efficient for separation of fragments of stainless steel from fragments of non-magnetic materials, fragments that have been obtained in the fragmentation of household machinery. The device has also proved to function excellently to separate fragments of vehicle tyres comprising steel cord from vehicle tire fragments that do not contain steel cord.

I claim:

1. A device for separation of fragments (20) of low-magnetic metallic materials from a mixture (19) of such fragments (20) and fragments (21) of non-magnetic materials, characterised by an endless conveyor belt (12), comprising a first belt run (12*a*) defining a separation plane having an upwards inclination in the direction of movement (P1) of the conveyor belt, and a second belt run (12*b*) located at the upper end of the separation plane and defining a discharge section; a first magnetic plate (14) extending in parallel with and closely underneath the first belt run (12*a*), from the upper end of said first belt run (12*a*) along at least part of the length thereof, and supporting a plurality of permanent magnets arranged in parallel rows (15) of alternate polarity (N, S); a transfer unit (18) for transferring the mixture (19) of fragments (20, 21) to the first belt run (12*a*) of the conveyor belt (12) at a predetermined downstream position (A) below which extends the first magnetic plate (14); and a second magnetic plate (16) disposed below the second conveyor belt run (12*b*) and supporting a plurality of permanent magnets arranged in parallel rows of alternate polarity, said second magnetic plate (16) having such an inclination relatively to the second belt run (12*b*) that the spacing between said second belt run and said second plate increases in the direction of movement (P1) of the conveyor belt (12).

2. A device as claimed in claim 1, characterised in that the rows (15) of permanent magnets disposed on the first magnetic plate (14) extend in the transverse direction of the conveyor belt (12).

3. A device as claimed in claim 1, characterised in that the rows of permanent magnets disposed on the second magnetic plate (16) extend in the transverse direction of the conveyor belt (12).

4. A device as claimed in claim 1, characterised in that the inclination of the second magnetic plate (16) relatively to the second belt run (12*b*) is adjustable.

5. A device as claimed in claim 1, characterised in that the inclination of the separation plane is adjustable.

6. A device as claimed in claim 1, characterised in that the inclination of the separation plane relatively to the horizontal plane is 40–60°, preferably about 50°.

7. A device as claimed in claim 1, characterised in that the transfer unit (18) consists of an essentially horizontally extending vibrating conveyor.

* * * * *